United States Patent [19]

Bianco

[11] 4,312,086

[45] Jan. 26, 1982

[54] MODULAR FURNITURE

[75] Inventor: David P. Bianco, York Harbor, Me.

[73] Assignee: George Nagem, North Hampton, N.H.

[21] Appl. No.: 123,778

[22] Filed: Feb. 22, 1980

[51] Int. Cl.[3] ..... A47B 83/00

[52] U.S. Cl. ..... 5/2 R; 5/9 R; 108/108; 248/188.1; 248/188.8; 248/220.3

[58] Field of Search ..... 5/2 R, 8, 9 R; 52/27, 52/36; 248/220.3, 220.4, 221.1, 221.2, 188.1, 188.8; 108/107, 108; 182/195

[56] References Cited

U.S. PATENT DOCUMENTS

| | | | |
|---|---|---|---|
| 3,040,905 | 6/1962 | Gingher et al. | 108/108 |
| 3,297,374 | 1/1967 | Radek | 108/108 |
| 3,316,564 | 5/1967 | Rogers, Jr. | 5/9 R |
| 3,952,342 | 4/1976 | Hart | 5/2 R |
| 4,119,177 | 10/1978 | Anderson | 182/195 |
| 4,186,666 | 2/1980 | Honickman | 52/36 |

*Primary Examiner*—Alexander Grosz
*Attorney, Agent, or Firm*—Harvey B. Jacobson

[57] ABSTRACT

A living system comprising a plurality of modular furniture components, the furniture components comprising integral bracket extensions which are insertable in recesses formed in a plurality of spaced, substantially parallel vertically disposed elongated columns, which form a frame for said living system, the elongated columns comprising telescoping legs placed at the end of each column adjacent the floor providing the frame with stability and enabling the living system to be placed close to a wall to increase usable space in the living environment. The modular furniture components include a bed, a plurality of storage components, a clothes rack, a telescoping ladder and may even include side panels to provide privacy and aesthetic value to the living system. All of the modular furniture components can be vertically adjusted and interchanged along the length of the elongated frame columns.

8 Claims, 9 Drawing Figures

FIG. 2
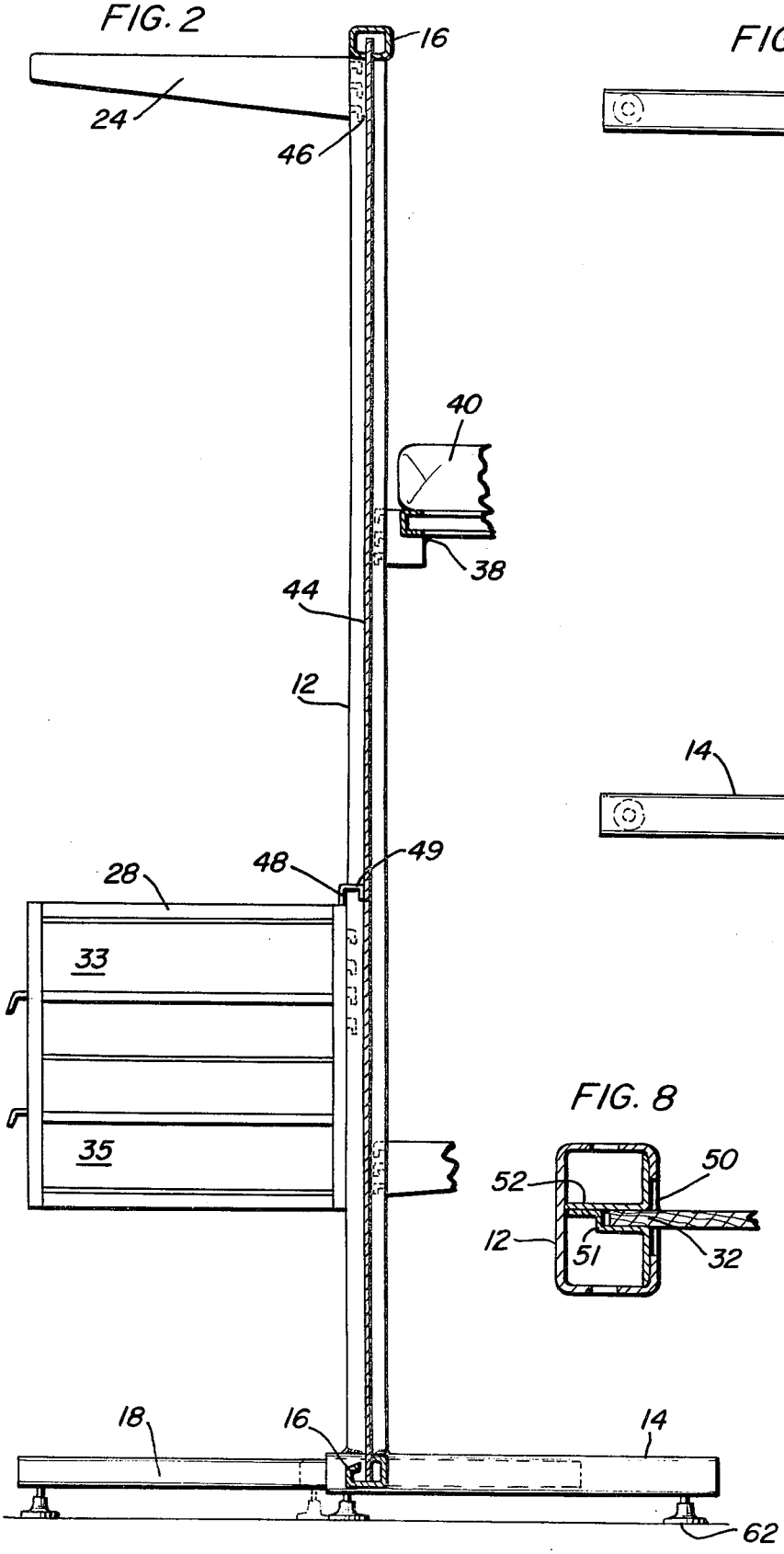
FIG. 3
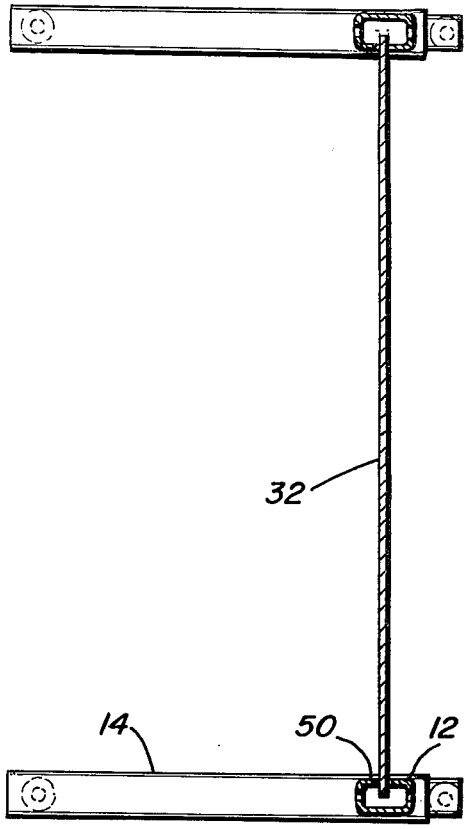
FIG. 7
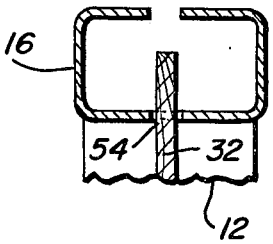
FIG. 8
FIG. 9
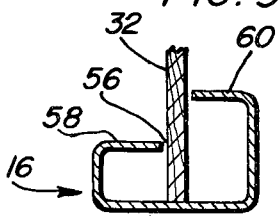

MODULAR FURNITURE

BACKGROUND OF THE INVENTION

1. Field of the Invention

This invention relates to a "living system" comprising a plurality of modular furniture components that can be arranged to meet individual needs and tastes and which utilize a minimum of space. In particular, a bed, desk, shelf, and storage components are joined in cantilever fashion to an elongated vertical frame which enables the individual furniture components to be interchanged and vertically adjusted along the length of the frame.

There are instances in which a plurality of conventional furniture components cannot be accommodated in living areas without resulting in a cramped and uncomfortable living environment. Such instances include dormitory rooms and sports villages which must accommodate many persons in a minimal amount of space. Further, handicapped persons in some instances find it very difficult to provide a workable and comfortable living environment with conventional separate furniture components. The present invention enables a variety of interchangeable furniture components to be joined and arranged on a single frame structure so that an entire living system can be formed in a minimal amount of space to meet particular needs. Beds can be adjusted for ease of entry, desks can be adjusted to accommodate wheelchairs, and the wardrobe rack of this invention can be adjusted downward to a convenient height.

The modular furniture of this invention can also provide a plurality of furniture components to meet individual needs and desires in less space and at significantly less cost than separate functional furniture components.

2. Disclosure Statement

Adjustable multipurpose furniture is disclosed in U.S. Pat. No. 3,952,342, issued Apr. 27, 1976, in which furniture components such as a bed, table and shelves can be vertically adjusted along four spaced vertically elongated columns. However, the method of attachment of the furniture components to the elongated frame columns is complex and does not provide for the easy adjustment and interchangeability of the individual furniture components as does the present invention. An article of furniture forming a childs's environment is disclosed in U.S. Pat. No. 3,950,796, issued Apr. 20, 1976, comprising a bed, a storage compartment and an adjustable shelf. Other combined individual furniture components are disclosed in U.S. Pat. No. 2,888,687, issued June 2, 1959, U.S. Pat. No. 3,316,564, issued May 2, 1967, and U.S. Pat. No. 3,325,233, issued June 13, 1967. None of these patents, however, teaches the versatility and easy adjustment of interchangeable modular components fastened on a frame structure.

SUMMARY OF THE INVENTION

The present invention provides for a living system which can accommodate individual needs and tastes in less space and at substantially lower cost than separate functional furniture components. The living system comprises a plurality of modular furniture components which are secured to an elongated vertical frame and which can be vertically adjusted and interchanged along the frame structure.

Briefly, the invention comprises a plurality of elongated vertical columns which include a plurality of recesses along the length of the columns which can receive bracket extensions of the furniture components. The furniture components include a bed, desk and shelf members, dresser and other storage drawers, an adjustable ladder to provide access to the bed, a wardrobe rack, and side wall panels to provide privacy and/or aesthetic value to the living system. The vertical frame members are supported on a telescoping leg base which provides stability to the system and which provides the system with the ability to be accommodated in various living areas. The living system can also include a pegboard and the like fitted between two of the frame columns by means of an elongated groove formed in the column structures. The pegboard enables a greater variety of components to be added to the living system to provide a flexible and comfortable living environment.

Accordingly, it is an object of the present invention to provide a living system formed of a plurality of various modular furniture components which can be adjusted to meet individual needs and desires in a minimum of space and at less cost than separate functional furniture components.

It is an additional object of the invention to provide a living system comprising modular bed and storage components which can be interchanged and adjusted along the length of an elongated vertical frame.

It is a further object of the invention to provide a multipurpose living system comprising a plurality of modular furniture components supported upon four frame columns wherein the columns include a plurality of recesses to permit brackets formed on said furniture components to be mounted to the columns at desired vertical locations and which also include channels to receive pegboard structures and the like which increase the versatility of the living system.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 2 is a vertical cross sectional view taken generally along line 2—2 of FIG. 1.

FIG. 3 is a transverse sectional view taken generally along line 3—3 of FIG. 1.

FIGS. 7, 8 and 9 are sectional views illustrating various ways in which the pegboard-like structure can be supported by the vertical columns which form the frame of the living system of this invention.

DETAILED DESCRIPTION OF THE INVENTION

Figure 1:
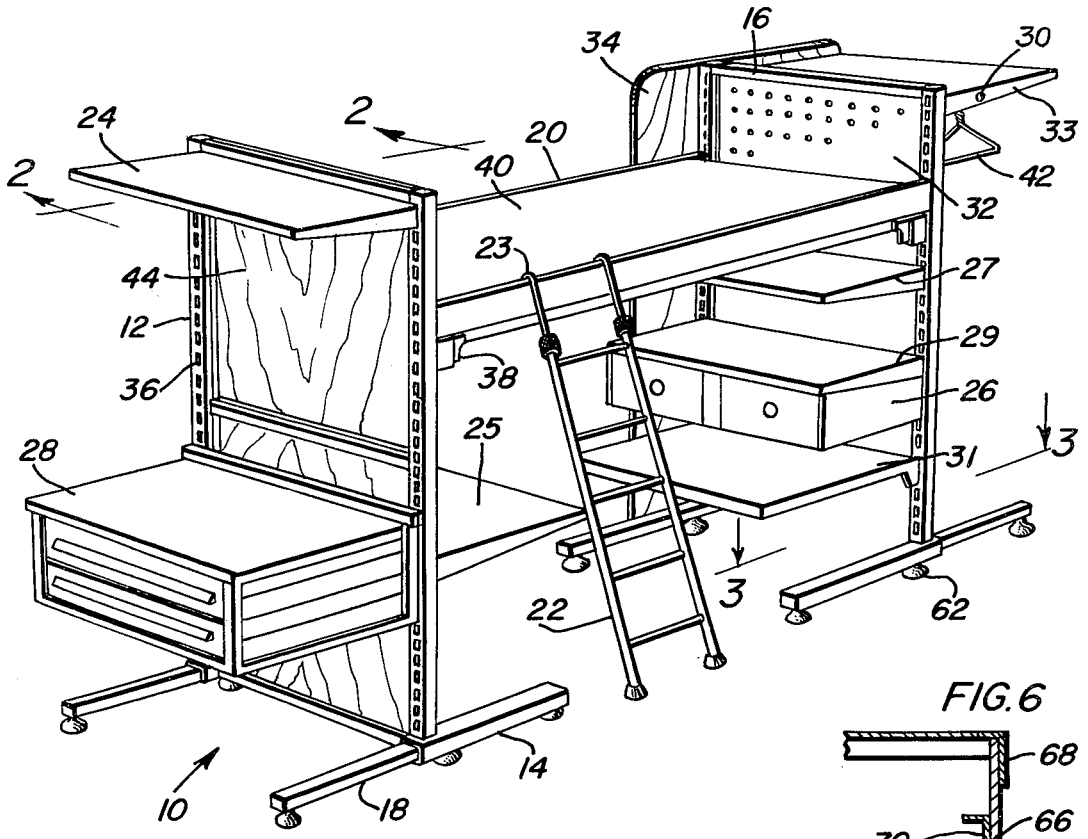
FIG. 1 is a perspective view illustrating a living system in accord with the invention.

The living system of the present invention is generally indicated by the numeral 10 in FIG. 1. The particular modular furniture components are shown arranged on four vertical columns 12 in a specific manner, the arrangement being interchangeable and the specific arrangement shown in FIG. 1 should not be so construed so as to limit the invention.

Each vertical column 12 is welded or otherwise secured to telescopic base 14, the columns arranged in a rectangular orientation to form a frame. The pairs of vertical columns 12 which form the width of the "rectangle" can be connected by horizontal supports 16 which are welded or fitted onto the ends of the columns. Telescopic base 14 and horizontal supports 16 provide living system 10 with stability and sturdiness to prevent lateral swaying of the completed frame assembly and enabling the system to be completely free standing, requiring no attachments to existing architecture. Telescopic base 14 includes leg extension 18 which is movable within the main base member enabling living system 10 to adjust for various shapes and sizes of living areas. As shown in FIG. 1, living system 10 is composed of a variety of modular furniture components, bed 20, telescoping ladder 22, six shelf units 24, 25, 27, 29, 31, 33, some of which may function as a desk, storage drawer 26, dresser 28, clothes rack 30, pegboard 32 and side wall panel 34. All of the modular furniture components are secured to the frame columns 12 by integral bracket means inserted into the spaced longitudinal slots 36 in each column. Recesses 36 provided on at least two opposing sides of each column 12 permit vertical adjustment of each furniture component and enable full use of the space surrounding living system 10. Bed 20 is shown in FIG. 1 as comprising metal spring frame 38 and mattress 40 but this bed could also be a conventional platform bed. Side wall panel 34 can be formed of wood or a simulated wood grain to add a pleasing aesthetic value to living system 10, but it can also be used to provide privacy such as a dressing area comprising clothes rack 30 on which is hung clothes hanger 42. Pegboard 32 can be used to hang various items dependent upon user and need, such as more drawers, shelves, mirrors, towel racks, organizers, etc. not shown in the drawings. On the side of the living system opposite the side which contains peg board 32, a chalk board or decorator panel 44 can be inserted between vertical columns 12. Ladder 22 contains hooks 23 adjustable to reach bed 20.

Vertical columns 12 are preferably made of metal such as steel and are of preferably hollow cross section to enable the placement of the brackets formed on the modular furniture components into the interior space. Columns 12 can be of square shape and include recesses 36 on at least two sides so that the space around living system 10 can be efficiently utilized. As shown in FIG. 2, shelf 24, bed spring 38 and dresser 28, all contain a plurality of bracket means 46 made into a hook shape to fit into longitudinal recesses 36 to secure the furniture components to vertical columns 12. Some furniture components such as dresser 28 containing drawers 33 and 35 need to be further supported by extension 48 which is an integral part of the dresser and includes two end hook means 49 which are also fitted into recesses 36. Vertical columns 12 also include a longitudinal groove 50 shown in FIG. 8 to support pegboard 32 or chalk board 44. Boards 32 or 44 can be further supported by a narrow channel 51 formed by metal extensions 52 in the interior of vertical column 12, though groove 50 may be the only support needed to secure the boards to the vertical column as shown in FIG. 3. Horizontal supports 16 placed at the top and bottom of vertical columns 12 include horizontal longitudinal grooves to further support pegboard 32 as shown in FIG. 2. An enlarged view of the horizontal support 16 placed at the top of vertical column 12 is shown in FIG. 7 illustrating a groove 54 into which a board such as pegboard 32 may fit. The bottom horizontal support 16 can be formed of an uneven cross section to provide leverage for a board in which a slot 56 is formed between flat top members 58 and 60 as shown in FIG. 9. Base 14 is supported on the floor by leveling means 62 which can adjust for unevenness in the floor structure. FIG. 2 also illustrates how leg extention 18 can be fully telescoped in base 14 as indicated by the dotted line.

FIG. 3 shows groove structure 50 formed in vertical columns 12 which can support pegboard 32. As shown in FIG. 3, slot 50 does not include narrow channel 51 formed by interior metal extensions 52. Either of the slot structures shown in FIG. 3 or FIG. 8 can be used to support pegboard structure 32 or chalk board 44.

Figure 6:
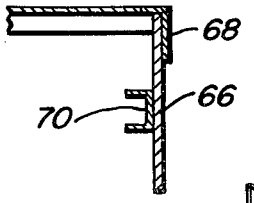
FIG. 6 is a transverse sectional view taken generally along line 6—6 of FIG. 4.
Figure 4:
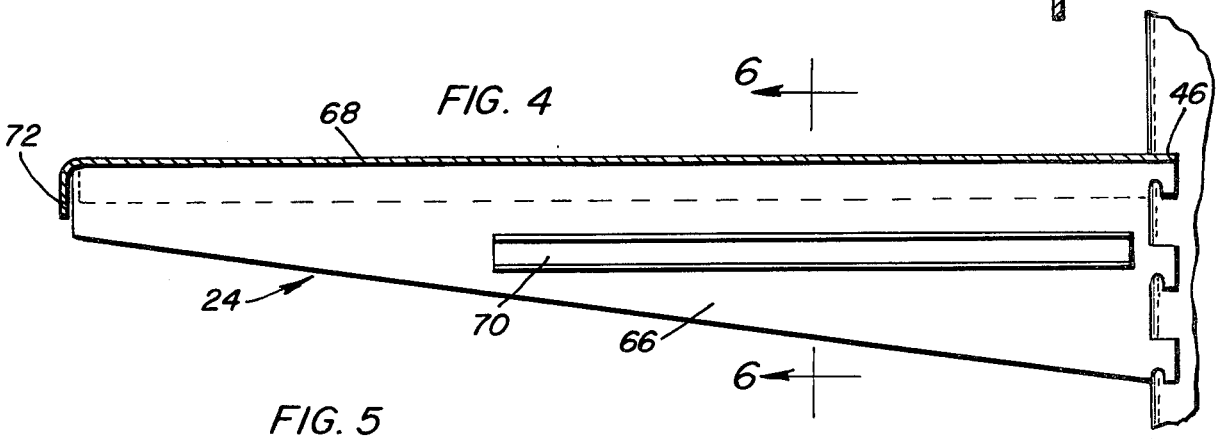
FIG. 4 is a cross-sectional view of a bracket for holding a storage drawer.

In FIGS. 4 and 6, a shelf unit 29 is shown which holds storage drawer 26. Shelf unit 29 is preferably formed of a unitary structure comprising a pair of side units 66, horizontal top 68, bended over each side 66 and welded thereto as shown by the dotted line in FIG. 4. The inside face of each side 66 includes track member 70 formed of a unitary lateral U-shaped metallic piece welded or otherwise fastened to side member 66. Top 68 may extend over the front of side units 66 to form a front lip portion 72.

Figure 5:
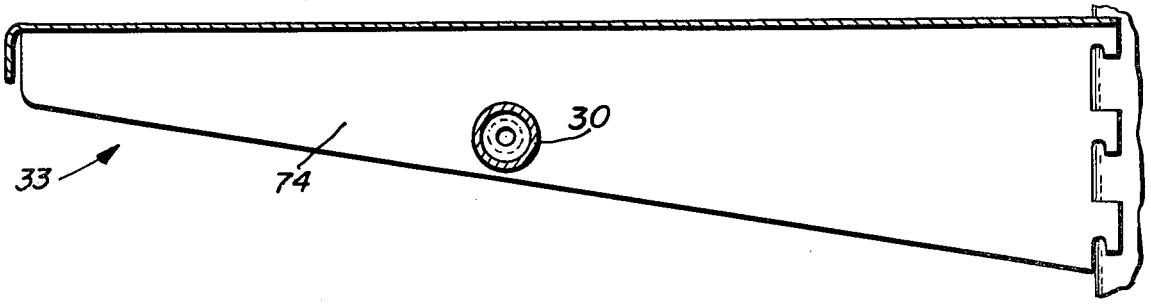
FIG. 5 is a cross-sectional view showing a bracket that supports a clothes rack.

In FIG. 5 is shown a section of shelf member 33 which contains clothing rack 30. A pair of elements 74 supports clothing rack 30 which can be welded to each side member 74 or placed through an aperture formed in the side members. Top 76 forms a storage surface and can be formed in the equivalent manner as top 68 including a front lip member.

It will be appreciated that living system 10 provides a practical combination of a bed and optional storage and desk components which can be vertically adjusted to meet individual needs and tastes. The individual modular components can be attached to the shelf by the simple insertion of bracket extensions 46 into the recesses or the longitudinal slots 36 in vertical columns 12. Since the slots are uniformly spaced from each other, incremental vertical adjustment of the furniture components can be made. To interchange the components, the components simply have to be lifted so that the bottom surface of bracket extension 46 no longer engages vertical column 12 and the piece removed out of engagement with the slots 36.

As can be appreciated, living system 10 can be used to accommodate numerous individuals in a minimal amount of space. For example, a second bed frame may be added to the vertical support member to provide a bunk-type of arrangement. The numerous shelves and drawers can be utilized to accommodate each individual's effects. Further, the vertically adjustable furniture components can be so arranged so as to provide a workable and comfortable living environment for the handicapped as living system 10 can be arranged to provide access to storage components and working desk components, as well as being vertically adjustable for hanging clothes.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A living system comprising at least four spaced, vertically disposed elongated columns arranged in a rectangular orientation to form a frame, each of said columns being supported by a base member, said columns comprising a plurality of vertically spaced longitudinal slots able to receive and secure a plurality of modular furniture components, said components being vertically adjustable on said columns, said living system including a bed mounted on said rectangular frame, said bed including unitary bracket extensions which are inserted into said slots of said columns, said columns having a plurality of sides, said slots being formed on at least two of said sides and at least one side of each of said columns forming an end of said frame containing a longitudinal groove, said living system including a pegboard inserted between at least the pair of columns forming said end, said pegboard supported by said longitudinal groove in each of said columns of said end, said base members comprising telescoping legs which are adjustable horizontally outwardly from said columns, said legs including levelling means to accommodate uneven floor surfaces.

2. The living system of claim 1 further comprising a shelf unit, said shelf unit comprising unitary extension brackets able to fit into said slots of said vertical columns.

3. The living system of claim 2 comprising a plurality of shelf units, at least one of said shelf units comprising a side member which includes a track guide able to receive a removable component.

4. The living system of claim 3 wherein at least one of said plurality of shelf units includes a clothing rack.

5. The living system of claim 4 wherein at least one of said shelf units include a desk member.

6. The living system of claim 1 including a telescoping ladder associated with said bed.

7. The living system of claim 1 including horizontal supports connecting said spaced elongated columns on each of said frame ends to provide stability and sturdiness and prevent lateral swaying of said frame.

8. The living system of claim 1 further including at least one decorator panel secured to one of said columns, said decorator panel being disposed in a plane parallel to the longitudinal direction of said bed.

* * * * *